US010391645B2

(12) United States Patent
Trull

(10) Patent No.: US 10,391,645 B2
(45) Date of Patent: Aug. 27, 2019

(54) MULTI-TRACK BEARING FOLDING KNIFE

(71) Applicant: Southern Grind, Inc., Peachtree City, GA (US)

(72) Inventor: Michael Dean Trull, Griffin, GA (US)

(73) Assignee: Southern Grind, Inc., Peachtree City, GA (US)

( * ) Notice: Subject to any disclaimer, the term of this patent is extended or adjusted under 35 U.S.C. 154(b) by 162 days.

(21) Appl. No.: 14/952,094

(22) Filed: Nov. 25, 2015

(65) Prior Publication Data

US 2017/0144316 A1 May 25, 2017

(51) Int. Cl.

| | |
|---|---|
| ***B26B 1/04*** | (2006.01) |
| ***B25G 1/00*** | (2006.01) |
| ***B26B 1/10*** | (2006.01) |

(52) U.S. Cl.

CPC ..... *B26B 1/04* (2013.01); *B25G 1/00* (2013.01); *B26B 1/10* (2013.01)

(58) Field of Classification Search

CPC ..... B26B 1/00–06; B26B 1/10
USPC ..... 30/267, 151–161; 384/504, 613, 619
See application file for complete search history.

(56) References Cited

U.S. PATENT DOCUMENTS 430,648 A * 6/1890 Hildreth ..... F16C 19/163 384/613
672,050 A * 4/1901 Williamson ..... B26B 13/28 30/267
2,032,281 A * 2/1936 Haywood ..... B26B 13/28 30/267
2,685,735 A * 8/1954 Sorensen ..... B26B 13/10 30/267
3,170,237 A * 2/1965 Weidauer ..... B26B 13/10 30/267
3,942,249 A * 3/1976 Poehlmann ..... B26B 1/046 30/160
3,951,473 A * 4/1976 Olschewski ..... F16C 29/069 384/43
3,973,809 A * 8/1976 Breteler ..... F16C 29/0688 384/43

(Continued)

FOREIGN PATENT DOCUMENTS

DE 4234714 A1 * 4/1994 ..... F16C 29/0685
GB 190815361 A * 11/1908

(Continued)

*Primary Examiner* — Jason Daniel Prone
(74) *Attorney, Agent, or Firm* — Thomas | Horstemeyer, LLP

(57) ABSTRACT

Disclosed are various embodiments for a multi-track bearing folding knife or folding tool. In various embodiments, a folding knife has a handle having a first side with a first side inner surface and a second side with a second side inner surface and a blade rotatably coupled to the handle, where the blade is configured to rotate from a closed position and an open position. A multi-track bearing may be disposed between the handle and the blade. The multi-track bearing may include a first plurality of balls positioned along a first circular path and a second plurality of balls positioned along a second circular path. The balls of the multi-track bearing may protrude from both a first side of the bearing and a second side of the bearing to contact two surfaces. A first guide and a second guide may be formed by a periodic rotation of the blade.

18 Claims, 8 Drawing Sheets

(56) References Cited

U.S. PATENT DOCUMENTS 4,204,717 A * 5/1980 Ernst ..... F16C 29/0688 384/43
4,214,365 A * 7/1980 Walter ..... B26B 19/20 30/224
4,307,920 A * 12/1981 Olschewski ..... F16C 29/0688 384/43
4,489,990 A * 12/1984 Teramachi ..... F16C 29/008 384/43
4,572,590 A * 2/1986 Teramachi ..... F16C 29/0607 384/45
4,572,591 A * 2/1986 Walter ..... F16C 29/0676 384/45
4,606,657 A * 8/1986 Tanaka ..... F16C 13/006 384/492
4,618,271 A * 10/1986 Li ..... F16C 19/55 384/613
4,729,669 A * 3/1988 Walter ..... F16C 29/0623 384/45
4,764,154 A * 8/1988 Teramachi ..... F16C 25/06 384/517
5,628,116 A * 5/1997 Kohno ..... B26B 13/28 30/267
5,694,694 A * 12/1997 Roskam ..... B26B 13/285 30/267
5,699,615 A * 12/1997 Chen ..... B26B 1/044 30/160
6,367,468 B1 * 4/2002 Edwards ..... B23D 47/02 30/374
6,749,341 B2 * 6/2004 Rio ..... A61B 17/1624 384/490
7,044,120 B1 * 5/2006 Rutters ..... B23D 47/02 30/374
7,905,023 B2 * 3/2011 Westerfield ..... B26B 1/044 30/155
7,934,871 B2 * 5/2011 Kawaguchi ..... F16C 19/182 384/474
8,001,693 B2 * 8/2011 Onion ..... B26B 1/02 30/155
8,261,633 B2 * 9/2012 Maxey ..... B26B 1/044 30/155
8,307,555 B2 * 11/2012 Onion ..... B26B 1/02 30/155
8,425,122 B2 * 4/2013 Bohr ..... F16C 19/38 384/548
8,668,391 B2 * 3/2014 Felis ..... F16C 19/182 384/512
8,770,849 B2 * 7/2014 Couillard ..... F16C 19/08 384/496
8,888,144 B2 * 11/2014 Cook ..... F16L 49/04 384/609
8,893,389 B2 * 11/2014 Freeman ..... B26B 1/046 30/155
8,939,054 B2 * 1/2015 Hawk ..... B26B 1/04 30/151
8,966,768 B2 * 3/2015 Onion ..... B26B 1/02 30/155
8,966,769 B1 * 3/2015 Mollick ..... B26B 1/04 30/161
9,109,623 B2 * 8/2015 Habibvand ..... F16C 19/08 384/521
2005/0223563 A1 * 10/2005 VanHoy ..... B26B 1/02 30/161
2006/0021230 A1 * 2/2006 Mikami ..... B26B 13/28 30/194
2007/0047855 A1 * 3/2007 Liu ..... F16C 29/04 384/49
2007/0234574 A1 * 10/2007 Constantine ..... B25B 7/08 30/254
2010/0189386 A1 * 7/2010 Dizlek ..... F16C 19/182 384/512
2011/0222807 A1 * 9/2011 Tanoue ..... F16C 19/182 384/517
2012/0234142 A1 * 9/2012 Onion ..... B26B 1/02 30/155
2012/0308172 A1 * 12/2012 Shaikh ..... F16C 19/182 384/523

FOREIGN PATENT DOCUMENTS

GB 190916066 A * 8/1909 ..... F16C 13/04
GB 983980 A * 2/1965 ..... F16C 19/182
JP 2000074050 A * 3/2000
WO WO 2015175465 A1 * 11/2015 ..... B26B 1/02

* cited by examiner

MULTI-TRACK BEARING FOLDING KNIFE

BACKGROUND

Various folding tools, such as folding knives, utilize a bearing with a single track of balls. This single track of balls causes all pressure caused by folding or unfolding the knife to be forced on protruding portions of the balls. In the event the balls or the bearing fails, the folding knife may no longer operate as intended.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

The present disclosure relates to folding tools, such as folding knives, having a multi-track bearing. As noted above, various folding tools, such as folding knives, utilize a bearing having a single track of balls. This single track of balls causes all pressure caused by folding or unfolding the knife to be forced on protruding portions of the balls. In the event the balls or the bearing fails, the folding knife may no longer operate as intended.

According to various embodiments as described herein, a folding knife or other folding tool may comprise a handle having a first side with a first side inner surface and a second side with a second side inner surface. A blade may be rotatably coupled to the handle using one or more suitable components where the blade is configured to rotate from a closed position to an open position and vice versa (referred to herein as "unfolding" or "folding").

At least one bearing may be disposed between the handle and the blade to facilitate the folding or unfolding of the blade, where the bearing comprises multiple tracks of balls disposed therein. The multiple tracks of balls may be described as a first plurality of balls being positioned along a first circular path and a second plurality of balls being positioned along a second circular path where individual ones of the first plurality of balls have a distance different than that of the second plurality of balls. The first plurality of balls and the second plurality of balls may be positioned in the bearing to protrude from a first side of the bearing and a second side of the bearing to contact two surfaces.

Further, the folding knife may comprise a first guide and a second guide formed by a periodic rotation of the blade made when folding or unfolding the blade from the folding knife. The first guide may receive the first plurality of balls while the second guide may receive the second plurality of balls. In the following discussion, a general description of a multi-track bearing folding knife and its components is provided, followed by a discussion of the operation of the same.

Figure 1A:
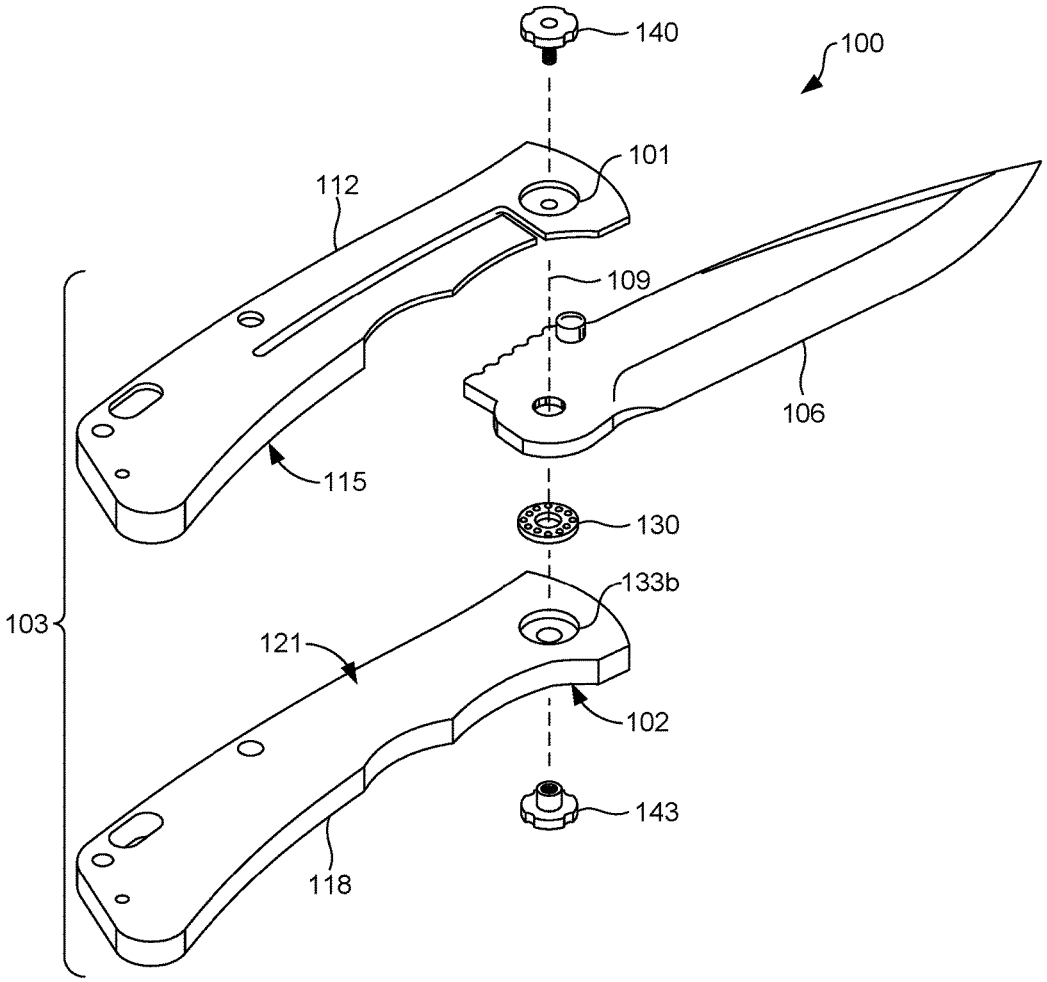
FIGS. 1A-1B show an exploded view of a folding knife having a multi-track bearing according to various embodiments of the present disclosure.
Figure 1B:
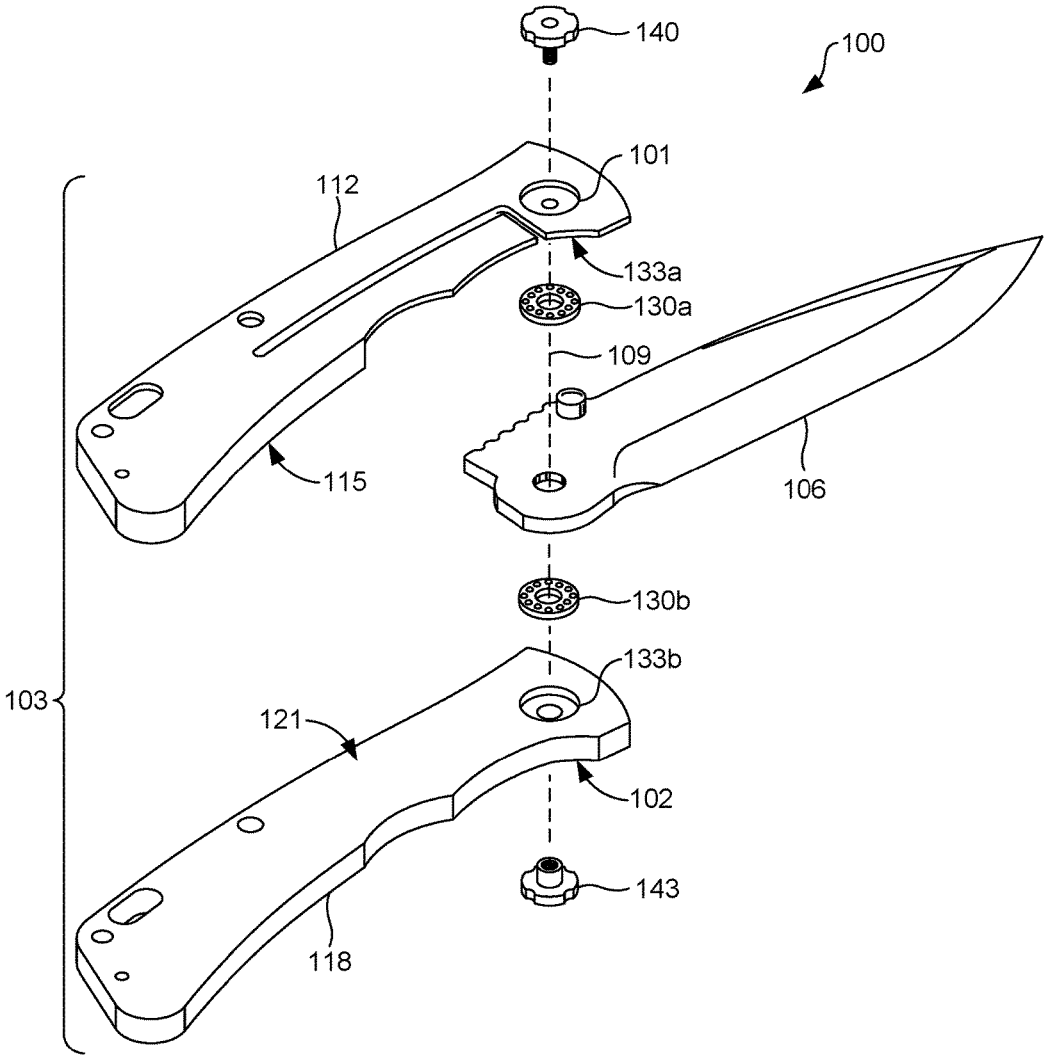

With reference to FIG. 1A and FIG. 1B, shown is an exploded view of a folding knife 100 according to one or more embodiments of the present disclosure. In the non-limiting example of FIG. 1A and FIG. 1B, the folding knife 100 may comprise a handle 103 and a blade 106, whereby the blade 106 is configured to rotate about a pivot point 109 to pull away from or insert into an interior of the handle 103 when a handle folds or unfolds the blade 106.

In various embodiments, the handle 103 comprises a first handle side 112 having a first side inner surface 115 and a second handle side 118 having a second side inner surface 121. The blade 106 may be rotatably coupled to the handle 103 using one or more components to ultimately make the blade 106 capable of rotation, whereby a handler of the folding knife 100 may move the blade 106 from a closed position and an open position, or vice versa. As may be appreciated, the closed (or folded) position of the folding knife 100 includes at least a portion of the blade 106 being disposed within an interior of the handle 103, such as between the first side inner surface 115 and the second side inner surface 121. The portion of the blade 106 disposed within the interior of the handle 103 may include a sharp edge of the blade 106 such that the folding knife 100 does not harm a handler when the folding knife 100 is not in use.

Although FIGS. 1A and 1B show an exploded view of the folding knife 100, the position of the blade 106 may be referred to as the open position where a sharp or cutting portion of the blade 106 is exposed. As may be appreciated, the open position may include the blade 106 being in a temporarily fixed state where extensive force may be applied to the blade 106 without causing the blade 106 to rotate or close. To this end, a lever or other suitable component may be manipulated by the handler to disengage the blade form the temporarily fixed state such that the blade 106 can be adjusted to the closed position.

The folding knife 100 may comprise a multi-track bearing 130 (also referred to herein as the bearing 130) that facilitates rotation of the blade 106 from the closed position to the open position. In various embodiments, the bearing 130 may be disposed between the handle 103 and the blade 106. However, in other embodiments, the bearing 130 may be disposed between other components, such as other bearings, springs, washers, etc., while ultimately being located at a position between the handle 103 and the blade 106. The non-limiting example of FIG. 1A depicts a use of a single multi-track bearing 130 while the non-limiting example of FIG. 1B depicts a use of two multi-track bearings 130*a* and 130*b*.

In various embodiments, the bearing 130 may comprise balls strategically placed on the bearing 130 to increase the longevity of the folding knife 100. For example, the bearing 130 may comprise a first plurality of balls and a second plurality of balls disposed thereon, where individual ones of the first plurality of balls have a radius (or distance to the center of the bearing 130) different than individual ones of the second plurality of balls.

In various embodiments, the balls of the bearing 130 are positioned to protrude from a first side of the bearing 130 and a second side of the bearing 130. As the non-limiting example of FIG. 1 shows the bearing 130 located between the blade 106 and the second side inner surface 121, a first side of the balls of the bearing 130 may come into contact with the second side inner surface 121 while a second side of the balls of the bearing 130 may come into contact with the blade 106. However, in other embodiments, the bearing 130 may come into contact with the first side inner surface 115 or another surface, such as a surface of a component positioned between the first side inner surface 115 or the blade 106.

In various embodiments, the bearing 130 may be disposed in a recess 133 of a surface, such as the first side inner surface 115, the second side inner surface 121, or a suitable portion of the blade 106. To this end, at least one side of the balls of the bearing 130 may come into contact with material of the recess 133, such as material of the first handle side 112, the second handle side 118, and/or the blade 106. In various embodiments, such material may include steel (e.g., stainless steel), tungsten, carbon, chromium, molybdenum, nickel, vanadium, any combination thereof, or any other suitable material.

The arrangement of the balls on the bearing 130 may cause formation of a plurality of guides in a surface of the material coming into contact with the balls of the bearing 130 based on concentric movement performed when an operator folds or unfolds the blade 106 on the folding knife 100. For example, a periodic rotation of the blade 106 from the closed position to the open position may cause formation of the guides, which may comprise grooves formed from periodic rubbing made between the surface of the material and the surface of the balls. Formation of the guides will be discussed in greater detail below.

In some embodiments, the bearing 130 may comprise a first plurality of balls arranged along a first circular path and a second plurality of balls arranged along a second circular path. Individual ones of the first plurality of balls may be positioned along the first circular path having a distance to a center of the bearing 130 different than individual ones of the second plurality of balls. Concentric movement made when the blade 106 is removed from or inserted into an interior of the handle 103 causes formation of a first guide and a second guide. As may be appreciated, the first guide may have a radius substantially similar or equal to that of the first plurality of balls while the second guide may have a distance substantially similar or equal to that of the second plurality of balls.

As individual ones of the balls in a track (e.g., the first plurality of balls) are offset from balls in another track (e.g., the second plurality of balls), the pressure caused between a surface of the balls and a surface is more evenly distributed when the blade 106 of the folding knife 100 is retracted from or inserted into the handle 103. A result of the contact made between the balls and a surface during concentric movements causes the guides to deepen and more closely conform to the shape of the surface of the balls. As a result, use of the folding knife 100 is improved instead of degraded. The durability and longevity of the folding knife 100 is therefore increased.

The folding knife 100 may be formed by positioning the components of the folding knife 100 (e.g., the blade 106, the bearing 130, the first handle side 112, and the second handle side 118) in their intended arrangement and securing the components together using a male adapter 140 and a female adapter 143, or other suitable connecting component(s). In some embodiments, the male adapter 140 may comprise a threaded portion that is received in and secured to the female adapter 143. The male adapter 140 and the female adapter 143 are received in recesses 101 and 102, respectively, formed in the first handle side 112 and the second handle side 118, respectively.

While the bearing of 130 of the folding knife 100 is described as having a first plurality of balls arranged along a first circular path and a second plurality of balls arranged along a second circular path, it is understood that additional balls can be placed along additional circular paths to cause formation of additional guides, as will be described. Also, the folding knife 100 of FIG. 1 may include other components, such as washers, screws, ridges, or other components traditionally found in folding knives, all of which are intended to be within the scope of the present disclosure.

Figure 9:
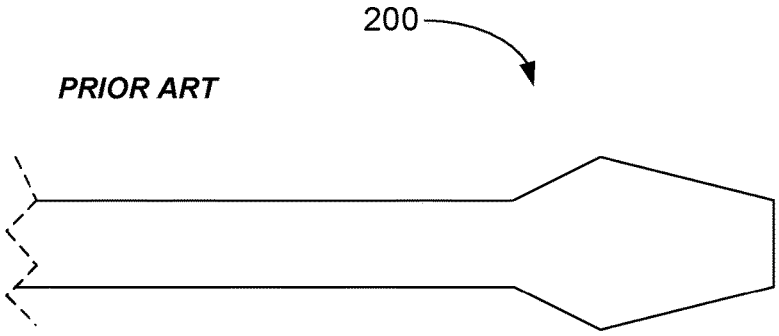
FIG. 9 is a plan view of a conventional screwdriver that may be part of a folding tool in accordance with an embodiment.

Further, in various embodiments, the folding knife 100 may comprise one or more components that automate a folding or unfolding of the blade 106. To this end, in some embodiments, the folding knife 100 may include a spring that applies a force to the blade 106 having sufficient strength to cause the blade 106 to rotate from the closed position to the open position or vice versa. While the embodiments herein may describe a blade 106 in view of a folding knife 100, in other embodiments, the folding knife 100 may be described as a folding tool, where in lieu of the blade 106 of FIG. 1, a screwdriver, a box cutter, or other tool may be configured to rotate from a first position to a second position. For instance, FIG. 9 is a plan view of a conventional screwdriver 200 that may be a component of such a folding tool in accordance with the inventive principles and concepts described herein.

Figure 2:
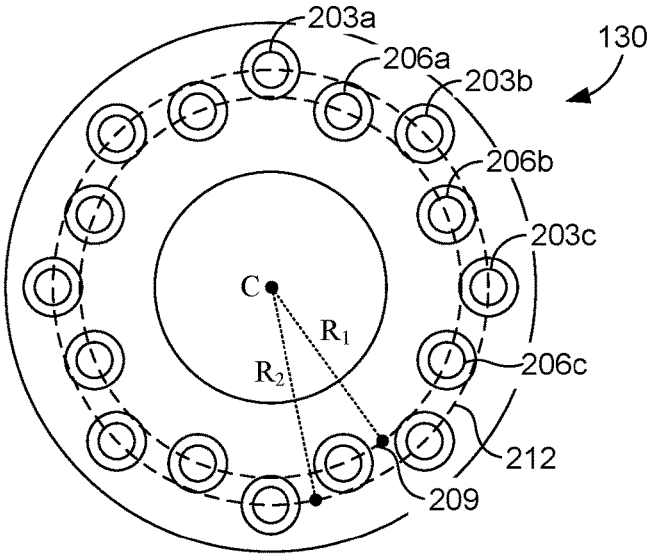
FIG. 2 shows a top view of an embodiment of the multi-track bearing of FIGS. 1A-1B having balls positioned along a first circular path and a second circular path according to various embodiments of the present disclosure.

Referring next to FIG. 2, shown is an embodiment of a multi-track bearing 130 for a folding knife 100 according to various embodiments. In some embodiments, the multi-track bearing 130 may comprise a first plurality of balls 203*a* . . . 203*c* and a second plurality of balls 206*a* . . . 206*c* (collectively first plurality of balls 203 and second plurality of balls 206, respectively) disposed within a surface of the multi-track bearing 130. According to embodiments described herein, the first plurality of balls 203 may be positioned along a first circular path 209 while the second plurality of balls 206 are positioned along a second circular path 212.

As may be appreciated, the first plurality of balls 203 and the second plurality of balls 206 may be fixed along a respective one of the circular paths 209/212 during manufacturing, where a center point of a given ball is positioned along one of the circular paths 209/212. Given a center point C, the first circular path 209 may be described as having a first radius $R_1$ while the second circular path 212 may be described as having a second radius $R_2$. As shown in FIG. 2, the first radius $R_1$ and the second radius $R_2$ are different from another such that the first plurality of balls 203 are offset from the second plurality of balls 206. In other words, a respective one of the first plurality of balls 203 and a respective one of the second plurality of balls 206 are at different distances from the center point C.

As a result of the different distances from the center point C, pressure caused between a surface of the balls 203/206 and another surface will be more evenly distributed when the blade 106 of the folding knife 100 is retracted from or inserted into the handle 103. Additionally, as a result of the first plurality of balls 203 being positioned along the first circular path 209 and the second plurality of balls 206 being positioned along the second circular path 212, multiple rotations of the folding knife 100 will cause a first guide and second guide to be formed in a suitable material in contact with a surface of the balls 203/206. The first guide and the second guide will be formed congruent to the first circular path 209 and the second circular path 212, respectively, as the balls 203/206 cause the first guide and the second guide to be formed by multiple rotations of the folding knife 100. Formation of the guides will be discussed in greater detail below.

Further, the material of the balls 203/206 may include a material suitable to avoid degradation over time when rubbed against another surface. In various embodiments, the material of the balls 203/206 includes steel (e.g., stainless steel), tungsten, carbon, chromium, molybdenum, nickel, vanadium, any combination thereof, or any other suitable material.

In some embodiments, the first plurality of balls 203 and the second plurality of balls 206 are fixed in the bearing 130, thereby preventing a rotation of the first plurality of balls 203 and the second plurality of balls 206. Instead of rotation, the circular shape of the balls 203/206 facilitate movement. In other embodiments, each of the balls in the first plurality of balls 203 and the second plurality of balls 206 are positioned in a ball race that allows a rotation of the first plurality of balls 203 and the second plurality of balls 206.

Figure 3:
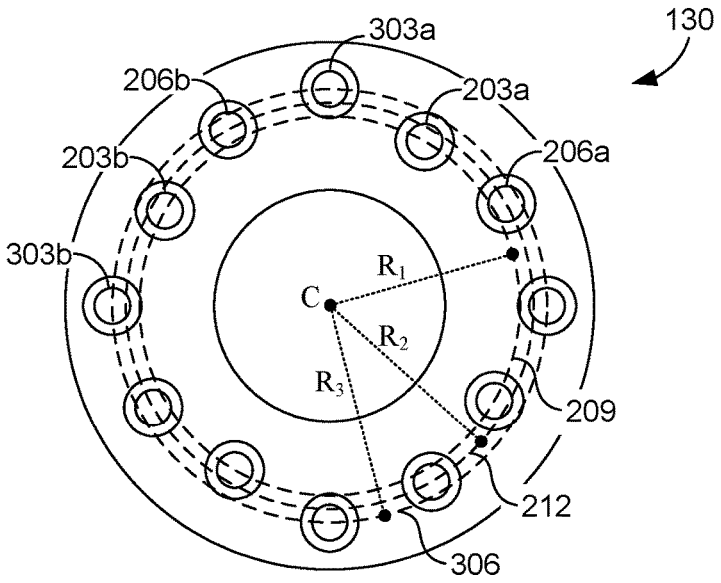
FIG. 3 shows a top view of an embodiment of the multi-track bearing of FIGS. 1A-1B having balls positioned along a first circular path, a second circular path, and a third circular path according to various embodiments of the present disclosure.

Turning now to FIG. 3, shown is another embodiment of a multi-track bearing 130 for a folding knife 100 according to various embodiments. In the non-limiting example of FIG. 3, the multi-track bearing 130 may comprise a first plurality of balls 203*a* . . . 203*b*, a second plurality of balls 206*a* . . . 206*b*, and a third plurality of balls 303*a* . . . 303*b* (collectively third plurality of balls 303), all disposed within a surface of the multi-track bearing 130. As noted above, the first plurality of balls 203 may be positioned along a first circular path 209 while the second plurality of balls 206 are positioned along a second circular path 212. Similarly, the third plurality of balls 303 may be positioned along a third circular path 306 while the first plurality of balls 203 are positioned along a first circular path 209 and the second plurality of balls 206 are positioned along a second circular path 212.

The first plurality of balls 203, the second plurality of balls 206, and the third plurality of balls 303 may be fixed along a respective one of the circular paths 209/212/306 during manufacturing. Given a center point C, the first circular path 209 may be described as having a first radius $R_1$, the second circular path 212 may be described as having a second radius $R_2$, and the third circular path 306 may be described as having a third radius $R_3$. The first radius $R_1$, the second radius $R_2$, and the third radius $R_3$ are different from one another such that the first plurality of balls 203 are offset from the second plurality of balls 206 and the third plurality of balls 303, and so forth. In other words, a respective one of the first plurality of balls 203 is located at a different distance from the center point C as compared to one of the second plurality of balls 206 or one of the third plurality of balls 303.

As a result of the different distances from the center point C, pressure caused between a surface of the balls 203/206/303 and another surface will be more evenly distributed when the blade 106 of the folding knife 100 is retracted from or inserted into the handle 103. Additionally, multiple rotations of the folding knife 100 will cause a first guide, a second guide, and a third guide to be formed in a suitable material in contact with a surface of the balls 203/206/303. The first guide, the second guide, and the third guide will be formed congruent to the first circular path 209, the second circular path 212, and the third circular path 306, respectively, as the balls 203/206/303 cause the first guide, the second guide, and the third guide to be formed by multiple rotations of the folding knife 100. As may be appreciated, the addition of balls in a fourth circular path and so forth may increase distribution of pressure when the blade 106 of the folding knife 100 is folded or unfolded.

Figure 4:
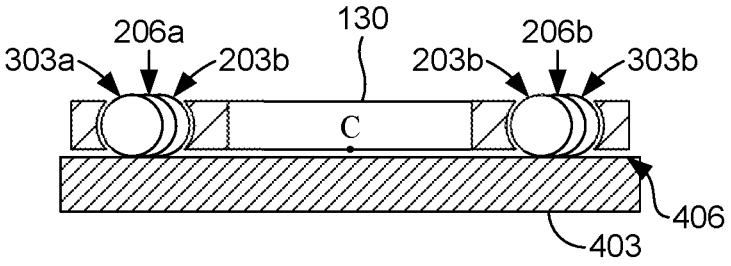
FIG. 4 shows a side view of an embodiment of the multi-track bearing of FIG. 3 having balls positioned along a first circular path, a second circular path, and a third circular path according to various embodiments of the present disclosure.

Moving on to FIG. 4, shown is a side view of an embodiment of a multi-track bearing 130 for a folding knife 100 according to various embodiments. In the non-limiting example of FIG. 4, the multi-track bearing 130 comprises the first plurality of balls 203*a* . . . 203*b*, the second plurality of balls 206*a* . . . 206*b*, and the third plurality of balls 303*a* . . . 303*b*, all disposed within a surface of the multi-track bearing 130. The balls of the multi-track bearing 130 may be positioned to protrude from a first side of the bearing and a second side of the bearing to contact two surfaces.

Also shown is a cross-sectional view of a material 403. During folding and unfolding of the blade 106 on the folding knife 100, a surface 406 of the material 403 may come into contact with a surface of the balls 203/206/303. As respective ones of the first plurality of balls 203 are located at a different distance from the center point C (as compared to one of the second plurality of balls 206 or one of the third plurality of balls 303), the pressure between the surface of the balls 203/206/303 and the material 403 is more evenly distributed. As may be appreciated, in some embodiments, the material 403 may comprise material of an inner portion of a handle 103 of the folding knife 100. In other embodiments, the material 403 may comprise material of another component of the folding knife 100.

Figure 5:
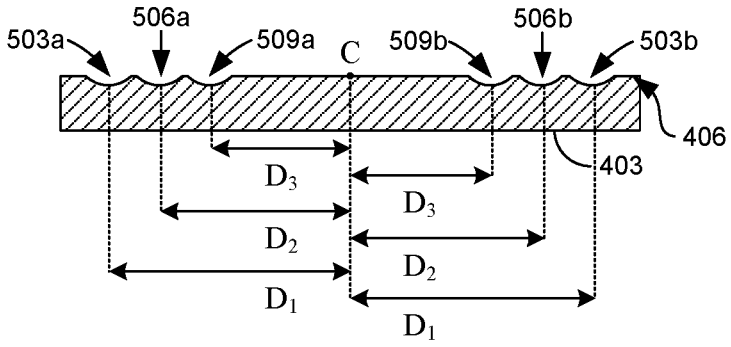
FIG. 5 shows a cross-sectional view of guides formed in a surface of a material by the multi-track bearing of FIGS. 1A-1B according to various embodiments of the present disclosure.

Referring next to FIG. 5, shown is another cross-sectional view of the material 403 having a surface 406 that comes into contact with the balls 203/206/303 of the bearing 130. For purposes of illustration, the material 403 is shown in FIG. 5 with the multi-track bearing 130 not being shown. As the first plurality of balls 203, the second plurality of balls 206, and the third plurality of balls 303 (e.g., positioned along the first circular path 209, the second circular path 212, and the third circular path 306) have different distances to a center point of the bearing 130, three guides may be formed where each guide has a unique distance from a center point C.

The pressure caused between a surface of the balls 203/206/303 and the surface 406 of the material 403 is more evenly distributed when the blade 106 of the folding knife 100 is rotated about a pivot point, as each group of balls 203/206/303 in the first circular path 209, the second circular path 212, and the third circular path 306 is offset from one another. Periodic use of the folding knife 100 likely results in many retractions and insertions of the blade 106 into the handle 103. Accordingly, the contact made between the balls 203/206/303 and the surface 406 of the material 403 causes a formation of a first guide 503*a* . . . 503*b*, a second guide 506*a* . . . 506*b*, and a third guide 509*a* . . . 509*b* in the surface 406 of the material 403.

As may be appreciated, the first guide 503, the second guide 506, and the third guide 509 will be formed concentric to the first circular path 209, the second circular path 212, and the third circular path 306, respectively, as the balls 203/206/303 cause the first guide 503, the second guide 506, and the third guide 509 to be formed. The distance between the first guide 503*a* . . . 503*b* and a center point C is denoted $D_1$, the distance between the second guide 506*a* . . . 506*b* and the center point C is denoted $D_2$, and the distance between the third guide 509*a* . . . 509*b* and the center point C is denoted $D_3$.

As a result of the contact made between the balls 203/206/303 and the surface 406 of the material 403, more use of the folding knife 100 will cause the guides 503/506/509 to deepen and more closely conform to the shape of the bottom surface of the balls 203/206/303. As more use causes the guides 503/506/509 to conform to the surface of the balls 203/206/303, use of the folding knife 100 is improved instead of degraded.

Figure 6A:
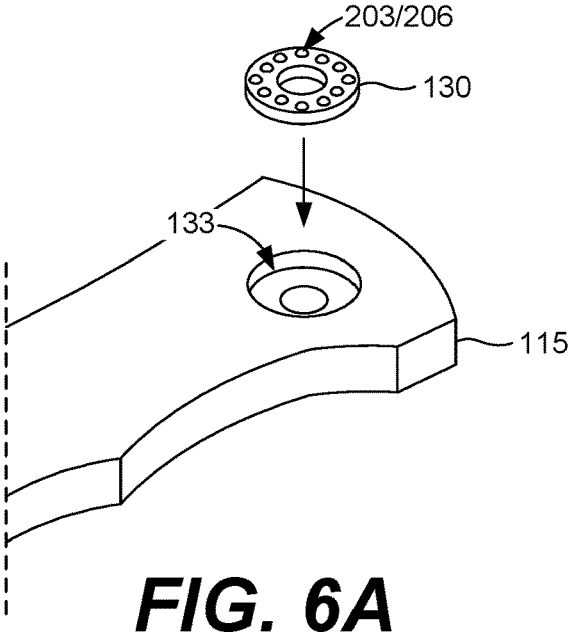
FIGS. 6A-6C show perspective views of an inner side of a handle of the folding knife of FIGS. 1A-1B according to various embodiments of the present disclosure.
Figure 6B:
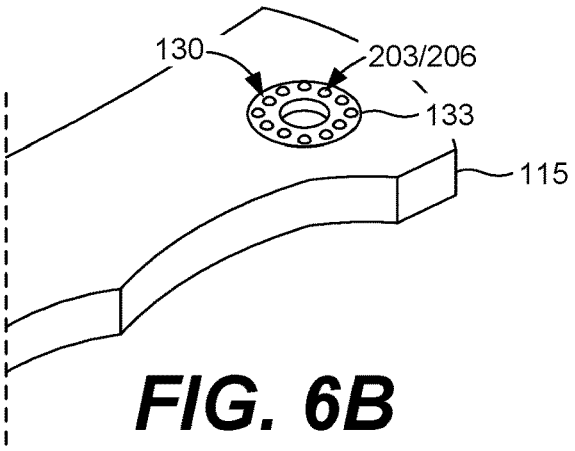
Figure 6C:
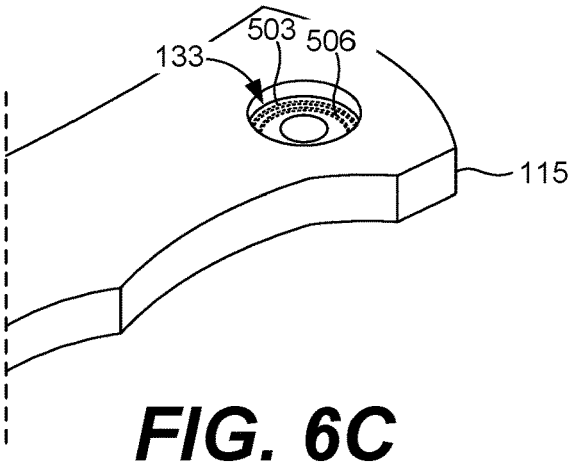

Turning now to FIGS. 6A-6C, perspective views of a side of the handle 103 of the folding knife 100 are shown according to various embodiments of the present disclosure. In the non-limiting example of FIGS. 6A-6C, the multi-track bearing 130 may be disposed in a recess 133 of a surface, such as the first side inner surface 115 of a first handle side 112, the second side inner surface 121 of a second handle side 118, or a recess 133 disposed in a suitable portion of the blade 106. To this end, at least one side of the balls of the bearing 130 may come into contact with material of the recess 133 while the other side of the bearing 130 may come into contact with another surface. In one embodiment, a first side of the balls of the bearing 130 may contact the blade 106 while the second side of the balls of the bearing 130 contacts a recess 133 disposed on the first side inner surface 115 or the second side inner surface 121.

In FIG. 6B, the multi-track bearing 130 of the folding knife 100 is shown being substantially encompassed within the recess 133 while a top portion of the balls 203/206 protrude from a plane level to the surface of the first side inner surface 115. As the first plurality of balls 203 and the second plurality of balls 206 (e.g., positioned along the first circular path 209 and the second circular path 212) have different distances to a center point of the bearing 130, two guides 503/506 may be formed in the recess 133.

For example, the pressure caused between a surface of the balls 203/206 and the surface of the material of the recess 133 is more evenly distributed when the blade 106 of the folding knife 100 is rotated about a pivot point, as each track of balls 203/206 in the first circular path 209 and the second circular path 212 are offset from one another. Periodic use of the folding knife 100 likely results in many retractions and insertions of the blade 106 into the handle 103. Accordingly, the contact made between the balls 203/206 and the surface of the material of the recess 133 causes a formation of a first guide 503 and a second guide 506, as shown in FIG. 6C.

Figure 7A:
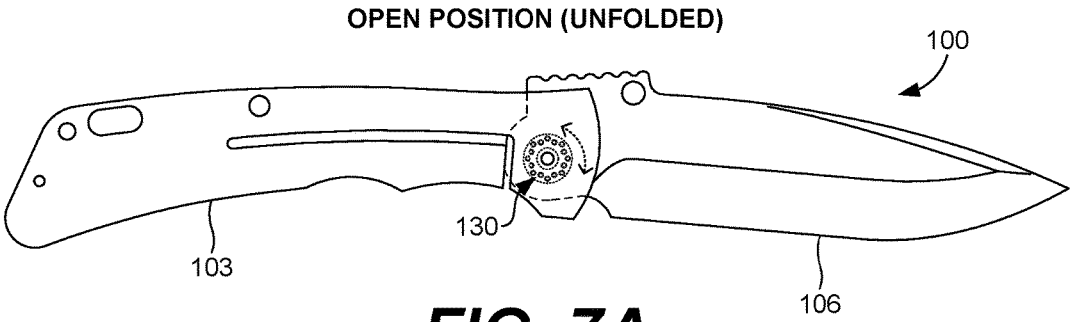
FIGS. 7A-7B show side views of the folding knife of FIGS. 1A-1B according to various embodiments of the present disclosure.
Figure 7B:
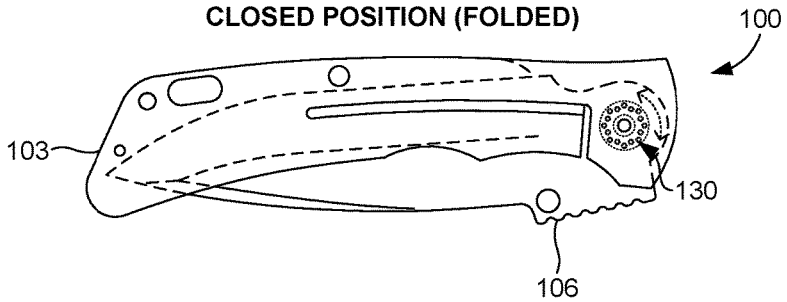

Turning now to FIG. 7A and FIG. 7B, side views of the folding knife 100 are shown according to various embodiments of the present disclosure. As described herein, the folding knife 100 includes a handle 103 formed by a coupling of a first handle side 112 and a second handle side 118. A blade 106 is rotatably coupled to the handle 103 using one or more components to ultimately make the blade 106 capable of rotation, whereby a handler of the folding knife 100 may move the blade 106 from a closed position and an open position, or vice versa. As may be appreciated, the closed (or folded) position of the folding knife 100 includes at least a portion of the blade 106 being disposed within an interior of the handle 103, such as between the first side inner surface 115 and the second side inner surface 121. The portion of the blade 106 disposed within the interior of the handle 103 may include a sharp edge of the blade 106 such that the folding knife 100 does not harm a handler when the folding knife 100 is not in use.

As may be appreciated, the bearing 130 of the folding knife 100 rotates as the blade 106 is folded or unfolded, thereby facilitating the closing or opening of the folding knife 100. As the bearing 130 includes a plurality of tracks of balls 203/206/303 positioned in a circular arrangement, the pressure caused between a surface of the balls 203/206/303 and a surface is more evenly distributed when the blade 106 of the folding knife 100 is retracted from or inserted into the handle 103. Further, concentric movement performed when the multi-track bearing 130 rotates along with the opening or closing of the blade 106 causes formation and modification of guides 503/506 within a surface of a material, creating a track or ridge that conforms to the shape and surface of the balls 203/206/303. As a result, extensive use of the folding knife 100 causes the rotation to be improved instead of degraded. The durability and longevity of the folding knife 100 is therefore increased.

Figure 8:
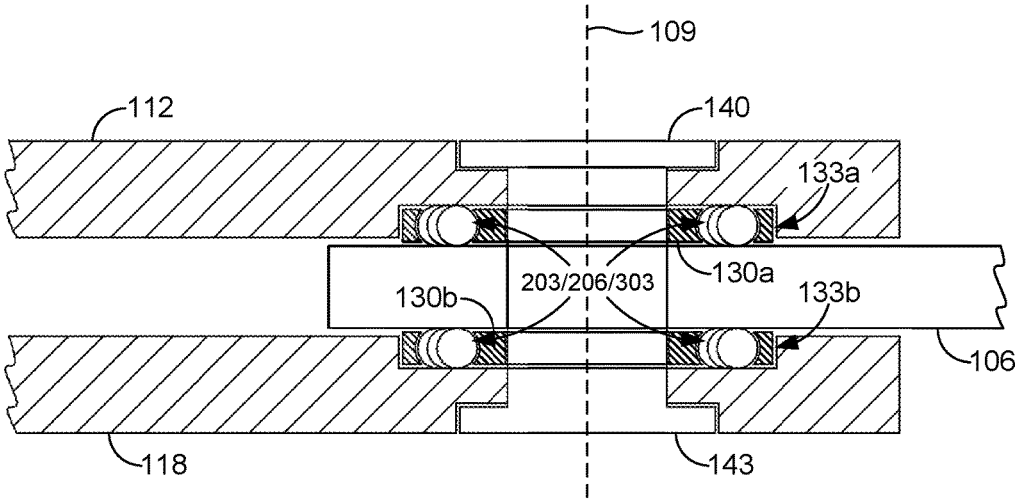
FIG. 8 shows a top view of the folding knife of FIGS. 1A-1B according to various embodiments of the present disclosure.

Referring next to FIG. 8, shown is a top view of a folding knife 100 according to one or more embodiments of the present disclosure. As shown in FIG. 8, the folding knife 100 may comprise the handle 103 and the blade 106, where the blade 106 is configured to rotate about a pivot point 109 to pull away from or insert into an interior of the handle 103 when a handle folds or unfolds the blade 106. The blade 106 may be rotatably coupled to the handle 103 using one or more components to ultimately make the blade 106 capable of rotation, whereby a handler of the folding knife 100 may move the blade 106 from a closed position and an open position, or vice versa.

Also shown in FIG. 8 is a first multi-track bearing 130*a* and a second multi-track bearing 130*b*, where the first multi-track bearing 130*a* is disposed between the first blade handle 112 and the blade 106 while the second multi-track bearing 130*b* is disposed between the second blade handle 118 and the blade 106. The first multi-track bearing 130*a* and the second multi-track bearing 130*b* may facilitate rotation of the blade 106 from the closed position to the open position, as may be appreciated. While being disposed between a respective handle 112/118, the bearing 130 may also be disposed between other components, such as other bearings, springs, washers, etc., while ultimately being located at a position between a handle 103/118 and the blade 106.

As discussed throughout, the bearing 130 comprises strategically placed balls 203/206/303 that increase the longevity of the folding knife 100. For example, the bearing 130 may comprise a first plurality of balls 203, a second plurality of balls 203, and a third plurality of balls 303 disposed thereon, where individual ones of the first plurality of balls 203 have a radius (or distance to the center of the bearing 130) different than individual ones of the second plurality of balls 206, also different from the third plurality of balls 303.

In various embodiments, the balls 203/206/303 of the multi-track bearings 130*a* and 130*b* are positioned to protrude from a first side of a respective bearing 130 and/or a second side of the respective bearing 130. Further, in various embodiments, the multi-track bearings 130*a* and 130*b* may be disposed in suitable recesses 133*a* and 133*b* of a surface, such as the first side inner surface 115, the second side inner surface 121, or a suitable portion of the blade 106. To this end, at least one side of the balls of the bearings 130*a* and 130*b* may come into contact with material of the recesses 133*a* and 133*b*, such as material of the first handle side 112, the second handle side 118, and/or the blade 106. In various embodiments, such material may include steel (e.g., stainless steel), tungsten, carbon, chromium, molybdenum, nickel, vanadium, any combination thereof, or any other suitable material.

Further, in various embodiments, the folding knife 100 may comprise one or more components that automate a folding or unfolding of the blade 106. To this end, in some embodiments, the folding knife 100 may include a spring that applies a force to the blade 106 having sufficient strength to cause the blade 106 to rotate from the closed position to the open position or vice versa. While the embodiments herein may describe a blade 106 in view of a folding knife 100, in other embodiments, the folding knife 100 may be described as a folding tool, where in lieu of the blade 106 of FIG. 1, a screwdriver, a box cutter, or other tool may be configured to rotate from a first position to a second position.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A folding knife, comprising:

a handle comprising a first side having a first side inner surface and a second side having a second side inner surface;

a blade rotatably coupled to the first side inner surface and the second side inner surface of the handle being configured to rotate from a closed position and an open position;

a bearing disposed between the first side inner surface of the handle and the blade via the rotatable coupling, the bearing comprising a first plurality of balls and a second plurality of balls disposed on a first side and a second side of the bearing, the first plurality of balls being positioned along a first circular path having a first radius from a center of the bearing, the second plurality of balls being positioned along a second circular path having a second radius from the center of the bearing that is different from the first radius, wherein the bearing is disposed within a recess of the first side inner surface, the first plurality of balls and the second plurality of balls of the bearing being in contact with the first side inner surface and the blade;

a first guide in the first side inner surface, the first guide being configured to receive the first plurality of balls; and a second guide in the first side inner surface, the second guide being configured to receive the second plurality of balls.

2. The folding knife of claim 1, wherein the bearing further comprises a third plurality of balls disposed on the first side and the second side of the bearing and positioned along a third circular path having a third radius from the center of the bearing, the third radius being different from the first and second radiuses.

3. The folding knife of claim 2, further comprising a third guide in the first side inner surface, the third guide being configured to receive the third plurality of balls.

4. The folding knife of claim 3, wherein each of the first plurality of balls, the second plurality of balls, and the third plurality of balls comprise stainless steel.

5. The folding knife of claim 1, wherein the first plurality of balls and the second plurality of balls are fixed in the bearing preventing a rotation of the first plurality of balls and the second plurality of balls.

6. The folding knife of claim 1, wherein the first plurality of balls and the second plurality of balls comprise steel, stainless steel, tungsten, carbon, chromium, molybdenum, nickel, vanadium, or a combination thereof.

7. A folding knife, comprising:

a handle comprising a first side having a first side inner surface and a second side having a second side inner surface;

a blade rotatably coupled to the first side inner surface and the second side inner surface being configured to rotate from a closed position and an open position;

a bearing disposed between the first side inner surface of the handle and the blade via the rotatable coupling, the bearing comprising a first plurality of balls and a second plurality of balls disposed on a first side and a second side of the bearing, the first plurality of balls being positioned along a first circular path having a first radius from a center of the bearing and the second plurality of balls being positioned along a second circular path having a second radius from the center of the bearing that is different from the first radius;

a first guide in the first side inner surface that receives the first plurality of balls; and a second guide in the first side inner surface that receives the second plurality of balls.

8. The folding knife of claim 7, wherein the bearing is disposed within a recess of the first side inner surface.

9. The folding knife of claim 7, wherein the first side of the bearing is in contact with the first side inner surface, and wherein the second side of the bearing is in contact with the blade.

10. The folding knife of claim 7, wherein the bearing further comprises a third plurality of balls disposed on the first side and the second side of the bearing and positioned along a third circular path having a third radius from the center of the bearing, the third radius being different from the first and second radiuses.

11. The folding knife of claim 10, further comprising a third guide in the first side inner surface that receives the third plurality of balls.

12. The folding knife of claim 7, wherein the bearing comprises a ball race; wherein each of the first plurality of balls and the second plurality of balls are positioned within the ball race to allow a rotation of the first plurality of balls and the second plurality of balls.

13. The folding knife of claim 7, wherein the first plurality of balls and the second plurality of balls comprise steel, stainless steel, tungsten, carbon, chromium, molybdenum, nickel, vanadium, or a combination thereof.

14. A folding tool, comprising:

a handle comprising a first side having a first side inner surface and a second side having a second side inner surface;

a tool rotatably coupled to the first side inner surface and the second side inner surface being configured to rotate from a first position and a second position through use of a bearing; and wherein the bearing is disposed between the first side inner surface of the handle and the tool that facilitates a rotation of the tool from the first position to the second position via the rotatable coupling;

wherein the bearing comprises a first plurality of balls and a second plurality of balls disposed on a first side and a second side of the bearing, the first plurality of balls being positioned along a first circular path having a first radius from a center of the bearing, the second plurality of balls being positioned along a second circular path having a second radius from the center of the bearing that is different from the first radius, the first side of the bearing being in contact with one of the first side inner surface and the second side of the bearing being in contact with the tool;

a first guide in the first side inner surface that receives the first plurality of balls; and a second guide in the first side inner surface that receives the second plurality of balls.

15. The folding tool of claim 14, wherein the bearing further comprises a third plurality of balls disposed on the first side and the second side of the bearing and positioned along a third circular path having a third radius from the center of the bearing, the third radius being different from the first and second radiuses.

16. The folding tool of claim 15, further comprising a third guide formed in the first side inner surface, the third guide being configured to receive the third plurality of balls.

17. The folding tool of claim 14, wherein the tool further comprises a blade, a screwdriver, or a box cutter configured to rotate from the first position to the second position.

18. The folding tool of claim 14, wherein the first plurality of balls and the second plurality of balls comprises steel, stainless steel, tungsten, carbon, chromium, molybdenum, nickel, vanadium, or a combination thereof.

* * * * *